United States Patent [19]

Shigenobu

[11] Patent Number: 4,533,231

[45] Date of Patent: Aug. 6, 1985

[54] FIXING DEVICE

[75] Inventor: Michio Shigenobu, Tokyo, Japan

[73] Assignee: Canon Kabushiki Kaisha, Tokyo, Japan

[21] Appl. No.: 652,415

[22] Filed: Sep. 19, 1984

[30] Foreign Application Priority Data

Aug. 4, 1981 [JP] Japan ..... 56-122613
Dec. 4, 1981 [JP] Japan ..... 56-181274[U]
Feb. 5, 1982 [JP] Japan ..... 57-17206

[51] Int. Cl.[3] ..... G03G 15/00

[52] U.S. Cl. ..... 355/3 FU; 355/14 FU; 118/60; 118/641; 219/216

[58] Field of Search ..... 118/60, 651, 661, 641; 355/3 FU, 14 FU, 15, 30 D; 430/125; 219/216; 29/132

[56] References Cited

U.S. PATENT DOCUMENTS 3,945,726 3/1976 Ito et al. ..... 219/216 X
3,967,042 6/1976 Laskin et al. ..... 219/216 X
4,083,092 4/1978 Imperial et al. ..... 355/3 FU X
4,114,021 9/1978 Nishide et al. ..... 219/216
4,145,599 3/1979 Sakurai et al. ..... 219/216
4,223,203 9/1980 Elter ..... 219/216
4,254,732 3/1981 Moser ..... 118/60
4,264,181 4/1981 Lentz et al. ..... 355/3 FU
4,329,565 5/1982 Namiki et al. ..... 219/216
4,341,458 7/1982 Glasa et al. ..... 355/3 FU
4,363,862 12/1982 Giorgini ..... 355/3 FU X
4,372,246 2/1983 Azar et al. ..... 118/60
4,395,109 7/1983 Nakajima et al. ..... 355/3 FU
4,435,069 3/1984 Sato ..... 355/3 FU

*Primary Examiner*—A. C. Prescott
*Attorney, Agent, or Firm*—Fitzpatrick, Cella, Harper & Scinto

[57] ABSTRACT

A fixing device for heating and fixing an unfixed image such as a toner image on an image supporting medium such as paper, in which the wait time is greatly shortened. The fixing device has a heating-fixing roller and a pressing roller. The pressing roller has a cellulars layer formed chiefly of HTV silicone rubber and having a number of isolated cells containing gases therein, and a relatively thin silicone rubber layer on the cellulars layer. The heating-fixing roller basically includes a thin-walled metal roller having substantially the same diameter as the pressing roller. Preferably, the heating-fixing roller is provided on the side which contacts the toner image.

31 Claims, 7 Drawing Figures

FIXING DEVICE

This application is a continuation of application Ser. No. 403,338 filed July 30, 1982, now abandoned.

BACKGROUND OF THE INVENTION

1. Field of the Invention

This invention relates to an image fixing device for fixing a toner image formed on an image holding member such as plain paper, photosensitive paper, etc. by the electrophotographic process, electrostatic recording process, magnetophotographic process and others.

2. Description of the Prior Art

A heating-fixing system has heretofore been adopted in a fixing device for fixing on a recording medium such as paper an unfixed image (hereinafter referred to as a toner image) formed by an image formation process such as electrophotographic process. In this type of heating and fixation, use has often been made of a device in which paper supporting a toner image thereon is conveyed between a heating roller provided with a heat source and a pressing roller urged against the heating roller.

In an image formation apparatus wherein such heating and fixation is effected, a fixing temperature of 150° C. to 200° C. has been required and therefore, a considerable time, i.e., about four minutes, has been necessary as the wait time after the main switch has been closed. Numerous technological inovations such as electrical control means and increased output of the heat source have been practised to reduce the wait time, but they have rather resulted in increased cost and other problems and complication of the apparatus.

Also, there are numerous problems in the construction of the heating and pressing rollers. For example, in the heating roller, heat distribution is liable to become nonuniform with respect to the axial direction thereof and heat dissipation is intense in the end portions of the roller, thus causing an increase in wait time. Further, during fixation, temperature rise may readily occur in the end portions because recording mediums of different widths are used and because the length of the roller is made longer than the width of the maximum size paper.

On the other hand, the roller provided on the pressing roller side can generally be grouped into three types, which have respective disadvantages as will hereinafter be described.

A first case is a fixing roller having a primer applied to a mandrel and a thick layer of silicone rubber or the like provided on the surface thereof, that is, a uniform elastic layer provided on a roller substrate. In this type of roller, oil or other additive must be added to reduce the elasticity of the elastic material such as rubber and as a result, the mechanical and physical characteristics of the elastic material are changed. Accordingly, it is impossible to reduce the hardness of the material so much while maintaining the characteristics thereof. Also, the pressure contact portion obtained relative to a supporting medium supporting thereon a toner image formed by the electrophotographic process or the like has been small and the amount of heat which can be imparted thereto per unit time has been small, and uneconomically, rubber or like material often used for the elastic layer has been required in a very great quantity and further, the wait time has become greater because the entire elastic layer must be heated, and this has increased the initial falling of the roller surface, thus causing insufficient fixation. An attempt to increase the number of heaters to prevent this has been uneconomical.

A second case is a fixing roller comprising a mandrel, a primer applied to the mandrel, and a porous member of silicone rubber provided thereon. A disadvantage peculiar to such roller is that it lacks the surface smoothness of the fixing roller and reduces the fixing ability and that where a parting agent is applied thereto, the porous member contains much of the parting agent and becomes ready to be deteriorated and thus, the durability thereof is inferior to rollers having solid or non-porus surfaces.

A third case is a multilayer construction in which two or three eleastic layers are provided to improve the oil-resisting property thereof. If multiple elastic layers are provided in this manner only for the purpose of improving the oil-resisting property, the cost thereof is greatly increased because a great deal of elastic material is used as previously described.

In the above-mentioned first and third cases, the plurality of layers or the thick rubber layer has led to a very great heat capacity, which in turn has resulted in an increased wait time and non-uniform temperature distribution throughout the length and therefore unsatisfactory fixation. This also holds true of the second case. Further, the use of much rubber material has led to high cost and poor durability.

As described above, in a fixing device having a heating roller and a pressing roller, there have been not only the problems of the individual constituents but also a combined problem caused by the required construction thereof and in particular, an increase in wait time has been caused.

SUMMARY OF THE INVENTION

The present invention has been made in order to solve the above-noted problems peculiar to the fixation of an object to be fixed.

It is an object of the present invention to provide a fixing device which reduces the wait time and has a fixing performance superior to the prior art device.

It is another object of the present invention to provide a fixing device which achieves uniformity of temperature in the surfaces of rotational members while maintaining its physical characteristics and which is high in durability.

It is still another object of the present invention to provide a fixing device provided with rotational members which are less expensive and more material-saving than the prior art device.

Other object of the present invention will become apparent from the following detailed description taken in conjunction with the accompanying drawings.

DESCRIPTION OF THE PREFERRED EMBODIMENTS

Figure 1:
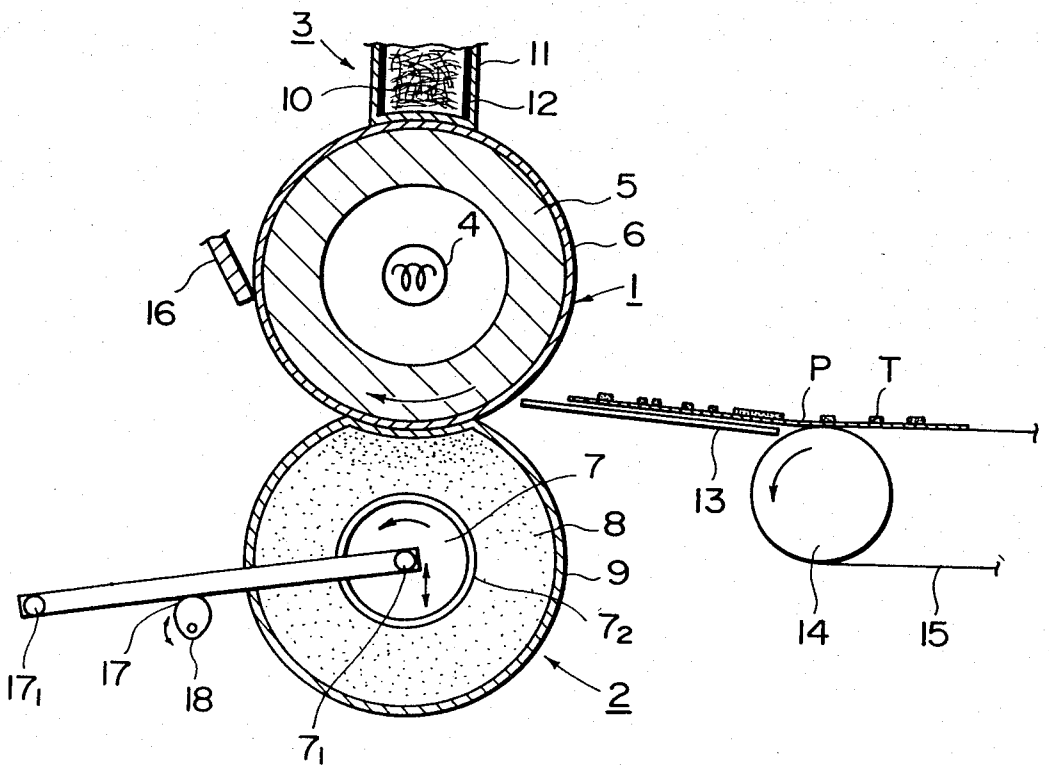
FIG. 1 illustates an embodiment of the present invention.

Referring to FIG. 1, reference numeral 1 designates a heating-fixing roller which comprises a metal roller 5 having heating means 4 therewithin and having the surface thereof provided with a Teflon coating layer 6. Reference numeral 2 denotes a pressing roller urged agianst the heating-fixing roller 1. The pressing roller 2 comprises a mandrel 7 which provides a rotational axis, a primer $7_2$ of one-liquid type RTV silicone rubber applied thereonto, a cellular layer 8 of cellular material adhesively secured to the primer $7_2$, and an elastic coating layer 9 of RTV silicone rubber applied onto the cellular layer 8. The surface of the pressing roller 2 has been finished by applying RTV (room temperature vulcanization) silicone rubber, and then polishing it to make up the shape thereof as a roller.

Cleaning means such as a cleaning blade 16 and offset preventing liquid applicator means 3 as described in Japanese Laid-open Patent Application No. 144268/1980 (which, as shown, has a silicone oil impregnated member 10, an impeding member 12 and a continuous porous member 11) bear against the Teflon coating layer 6 of the heating-fixing roller 1.

Further, the pressing roller 2 has means for varying the urged condition thereof relative to the heating-fixing roller 1, for example, means provided with an arm 17 for rotatably supporting the mandrel 7 and varying the position thereof with a mount point 71, a point 171 which is the axis of pivotal movement of the arm 17 and cam means 18 for varying the position of the arm 17 as indicated by the dotted arrow.

Now, paper P having thereon a toner image T formed by predetermined image formation means is conveyed with movement of a belt 15 passed over a pair of conveyor rollers 14. The paper P is then shifted from the belt 15 to a guide member 13 and directed to a wide pressure contact portion between the heating-fixing roller 1 and the pressing roller 2.

On the other hand, in the above-mentioned wide pressure contact portion, there are formed the layer 6 uniformly heated by the heating means 4 and the elastic coating layer 9 uniformly heated by the conducted heat from the heating-fixing roller 1, and on the pressing roller 2, the heat is higher in the coating layer 9 than in the cellular layer 8 due to the above-described construction and therefore, the wait time during the rising (the time required until the process can be started) is very much shortened. Further, in the cellular layer 8, there is a large volume occupied by cellular material components and gases such as air and therefore, the heat conductivity of the cellular layer 8 is lower than that of the coating layer 9. That is, the amount of heat required for the heating-fixing roller 1 to maintain the entire pressing roller 2 itself at a predetermined temperature may be slight as compared with that in the conventional device, and the heat is not consumed in a large amount and wastefully and this leads to a highly improved heat efficiency. Further, even if the apparent hardnesses of the roller surfaces are the same as each other, the above-described embodiment having the cellular layer 8 is easier to deform than a solid single piece and also, the pressure contact portion between the rollers can be secured more widely.

Accordingly, even if the amount of heat by the toner per unit time is the same, heating and contact can be effected for a longer time, so that heat can be imparted to the toner image (or the paper P).

Next, when the paper P enters the wide pressure contact portion, the toner image supported thereby is permanently fixed on the paper P by uniform heat from above and below. At this time, in the paper P which is an example of the supporting member, wrinkles which are liable to occur during fixation have not at all occurred in spite of the fact that the step of working the paper into an inverted crown shape or the like which is generally known as the measure against wrinkling is not taken.

The cellular layer 8 has many cells containing gases, and most of these cells are isolated cells (expanded foams or expanded cells) each of which is independent and isolated from others. However, the cellular layer 8, even if it contains more or less interconnected cells (sponge), will be applicable to the present invention if it provides the desired elasticity and the desired adiabatic property. However, the cellular layer in the present embodiment and the ensuing embodiments consists of isolated cells containing gases (for example, air and gasified additives in the rubber), and has a film of resin such as silicone rubber as the diaphragm. This has an advantage that the isolated cells are higher in adiabatic effect than the interconnected cells and more abound in elasticity and are readier to provide a predetermined pressure.

The result of the above-described embodiment will now be statistically evaluated to describe the excellent effect of the embodiment of the present invention. The following experiment was carried out with the outer diameter of the roller being 25$\phi$ and (1) with the construction thereof being a double structure having a rubber layer of 1 mm thickness on the silicone cellular layer of 6 mm thickness and (2) with the construction thereof being a single structure having an elastic layer comprising a silicone rubber layer of 7 mm thickness, and under the same condition that their surface hardnesses in the roller form are both JIS-A6°. This roller was opposed to a Teflon coat roller having an outer diameter of 25$\phi$ and was pressed with a predetermined pressure, and the resultant variation in amount of nip and the rate of creation of wrinkles were examined.

As a result, when the roller 1 according to the present invention was used and pressed with a total pressure of 4 kg, the width of the pressure contact was 4.6 mm and the creation of wrinkles when copying was continuously effected on 1000 sheets of A4 size paper was less than 0.15%. In contrast, when the roller 1 according to the prior art was used and pressed with a total pressure of 4 kg, the width of the pressure contact was as slight as 2.7 mm and the creation of wrinkles when copying was continuously effected on 1000 sheets of A4 size paper was normally in the range of 0.7–1%.

Also, comparing the fixing aiblity by the above-described experiment, if a predetermined pressure (a total force of 3.5 kg or greater) and a predetermined temperature (175° C. or higher) are used during continuous copying, there is a pressure difference per unit area but the products of pressure and temperature per unit time become substantially equal to each other and therefore, there could be found no particular difference between the roller of the above-described example (1) and the roller (2) of the prior art because of the stable condition of the continuous copying other than the fact that a higher quality of image can be provided by the roller of the example (1) than by the roller (2) of the prior art.

However, in the initial condition wherein fixation is started or in an apparatus wherein the fixing (heating) roller and the above-described pressing roller are brought into and out of contact during each fixation, the example (1) according to the present invention could provide an image having a particularly good fixativeness and high quality.

As described above, by using the above-described embodiment of the present invention, namely, a fixing roller of double structure having a silicone rubber layer on a cellular layer, it has become possible to obtain the following numerous advantages.

That is., it has become possible to prevent the reduction in fixing during the wait-up which could heretofore not be solved by any means because the heat conduction of the lower roller was extremely poor due to the cellular layer and the reduction in the surface temperature of the roller immediately after the wait-up was small.

Further, the roller is manufactured as described above and therefore, the amount of rubber used is decreased to about ½ or less and this contributes to the saving of the material and the reduced cost.

Also, a large and uniform pressure contact portion can be secured with the contact pressure between the pressing roller and the fixing roller reduced and therefore, the torque for driving can be reduced and further, it has become possible to reduce the ill effect of the compressive permanent distortion of the rubber roller. Also, it has been found that when the roller is formed of a single silicone cellular material layer and used for fixation, the cells thereof cause creation of portions good in fixation and portions bad in fixation and this is not preferable and surface smoothness is required.

Figure 3:
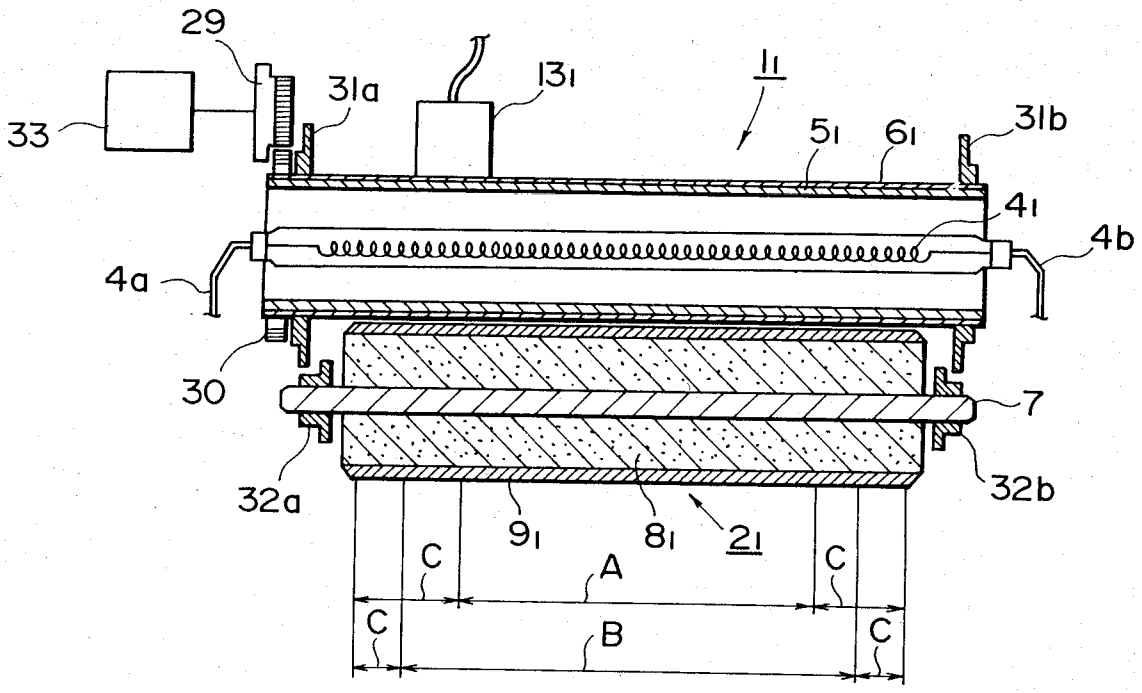
FIG. 3 illustrates still another embodiment of the present invention.

As the experiment was further continued and when examination was carried out by varying the thickness of the silicone rubber surface layer from 0.3 mm to 5 mm, it was found that if the thickness was too great, the effect of the cellular layer abounding in elasticity and restitutional property could not be utilized so effectively and that if the thickness was too small, it resulted in decreased strength and increased cost of manufacture as well as poor stability and therefore, a thickness of 0.5 mm to 2 mm was preferable and a thickness of 0.7–1 mm was more preferable (but this was with respect to the roller diameter of 25$\phi$). This pressing roller, as shown in FIG. 3, has its end surface not covered with a silicone rubber layer. That is, the rubber layer is provided only on the peripheral surface of the pressing roller, and a rubber layer is present on the peripheral surface of each of the left and right side thereof, and the pressing roller has a silicone rubber cellular layer inside thereof. Thus, heat distribution can be more uniformized with respect to the lengthwise direction of the roller.

Another embodiment may be not only a method of applying a tube of cellular material to form a silicone cellular layer but also a method of causing rubber to be foamed around a usual mandrel and thereafter vulcanizing the rubber.

As an inexpensive method, a tube of silicone rubber may be applied, whereafter it may be placed into a metal mold and NVR (low temperature vulcanization type) silicone rubber may be poured into between the cellular layer and the metal mold by the injection system. This method eliminates the necessity of polishing because of the accuracy of the parting surface of the metal mold and is suitable for mass production.

By providing on a roller substrate a layer poor in heat conductivity and abounding in elasticity and restitutional property such as a silicone cellular layer or a porous layer of fluorine rubber, further providing on the surface thereof a layer of elastic material such as a thin layer of silicone rubber and thereby making a double structure, there can be provided a roller which has a great heat capacity and abounds in surface smoothness and which can form a uniform predetermined nip width by a low contact pressure and thus, it has become possible to eliminate the problems peculiar to the prior art and to provide a roller which is inexpensive and which saves the material used and has a great allowance for paper wrinkling and further has a great error range of assembly accuracy.

The fixing device of the present invention, as described above, is one which provides good fixing ability during the starting, permits free elastic deformation, maintains a high quality of image resulting from the particularly good fixing ability and has a very high anti-wrinkling effect and which eliminates the necessity of adding a filler as in the prior art and does not reduce the physical property of the construction itself and which is economical and material-saving and easier to manufacture.

Figure 2:
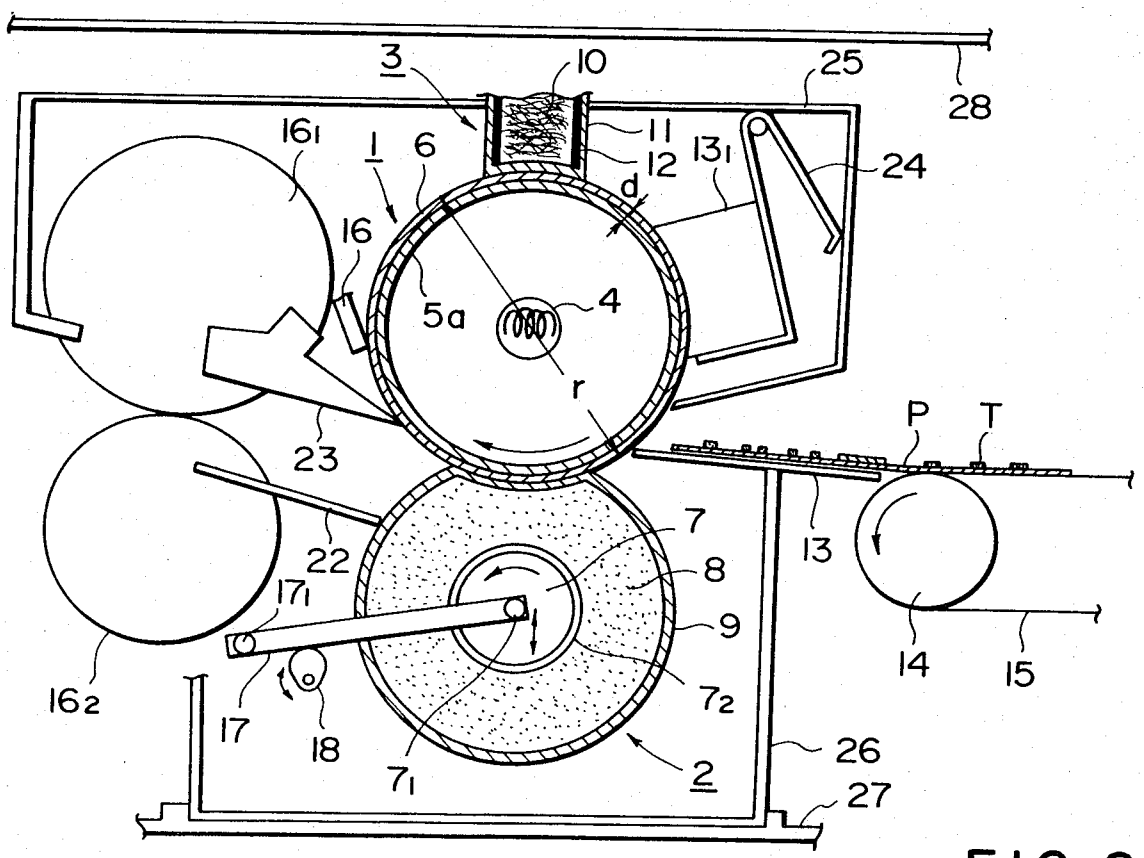
FIG. 2 illustrates another embodiment of the present invention.

FIG. 2 shows an embodiment further improved over the embodiment of FIG. 1. The construction of FIG. 2 includes parts identical to those of FIG. 1 and therefore, description will hereinafter be made chiefly of the differences of the FIG. 2 construction from the FIG. 1 construction. A feature of the FIG. 2 embodiment is that the construction of the heating-fixing roller has a thin-walled metal roller 5*a* of wall thickness d and a coating layer 6 of tetrafluoroethylene resin around the metal roller. In the present embodiment, the diameter r of the roller 5*a* is 25 mm, whereas the wall thickness d thereof is 2.5 mm. The pressing roller 2 has the mandrel 7, a primer $7_2$ of one-liquid type RTV silicone rubber, a cellulars layer 8 formed of silicone cellular material, and an elastic coating layer 9 formed of RTV silicone rubber. If the same material is used as the base of the cellular layer 8 having elasticity and the elastic coating layer 9 in this manner, the joining property and durability thereof will be improved. Further, in the present embodiment, the same material is also used as the primer $7_2$ and therefore, the joining property thereof with respect to the mandrel is improved.

The elastic coating layer 9 is smaller in layer thickness than the cellular layer 8 and the temperature distribution therein when the layer 9 is heated is ready to be stabilized.

The other construction in the present embodiment has the aforedescribed pressure adjusting means.

In the present embodiment, a pressure of the order of 15 kg/cm is applied between the heating-fixing roller 1 and the pressing roller 2. Cam means 18 may be operated in response to the approach of a recording medium such as paper P or may be urged by a copy start signal, and usually (during non-use of the apparatus, the rollers 1 and 2 are maintained in contact with or spaced apart from each other), this pressure adjusting means may preferably be provided but need not always be provided.

A contact type thermistor $13_1$ is urged against the peripheral surface of the heating-fixing roller 1 by a plate spring 24 so as to maintain a predetermined pressure contact force. This thermistor $13_1$ has a resin tape-like member on its surface so as not to injure the surface of the fixing roller, and holds a temperature detecting element (not shown) by means of a sponge-like elastic member.

Reference numeral 23 designates a separating pawl for separating paper P from the heating-fixing roller 1. Reference numeral 22 denotes a guide plate on the pressing roller 2 side. The guide plate 22, together with the separating pawl 23, secures a transportation path for the paper P. Designated by $16_1$ and $16_2$ are paper discharge rollers for discharging the paper P after fixed outwardly of the image formation apparatus or onto a tray.

In FIG. 2, reference numeral 25 designates an upper support frame for integrally holding the fixing unit (the construction of which has been described in connection with FIG. 1), and reference numeral 26 denotes a similar lower support frame. Designated by 27 is a guide member in the image formation apparatus which removably supports the lower support frame 26 of the fixing unit. Denoted by 28 is a fixed frame in the image formation apparatus which is spaced apart from the upper support frame surrounding the thermistor $13_1$.

Now, the paper P having thereon a toner image T formed by predetermined image formation means is conveyed with movement of a belt 15 over a pair of conveyor rollers 14. The paper P is then shifted from the belt 15 to a guide member 13 and directed to the pressure contact portion between the heating roller 1 and the pressing roller 2. At this pressure contact portion, the toner image T is molten and fixed onto the paper P, which is then discharged.

On the other hand, in the above-mentioned pressure contact portion, there are formed the metal roller surface 5 uniformly heated by heating means 4, the coating layer 6 and the elastic coating layer 9 uniformly heated by the conducted heat from the heating-fixing roller 1. This heatingfixing roller 1 is of a thin wall thickness and therefore reaches a predetermined temperature on the spot. The pressing roller 2 is heated by the hot heating-fixing roller and, due to the above-described construction, the coating layer 9 thereof is higher in heat conductivity than the cellular layer 8 thereof and therefore, the wait time during the starting (the time required until the process can be started) is much more shortened than in the embodiment of FIG. 1. Further, in the cellular layer 8, there is a large volume occupied by cellular material components and gases such as air and therefore, the heat conductivity of the cellular layer 8 is lower than that of the coating layer 9. That is, the amount of heat required for the heating-fixing roller 1 to maintain the entire pressing roller 2 itself at a predetermined temperature may be slight as compared with that in the conventional device, and the heat is not consumed in a large amount and wastefully and this leads to a highly improved heat efficiency. Further, even if the apparent hardnesses of the roller surfaces are the same as each other, the above-described embodiment having the cellular layer 8 is easier to deform than a rubber solid single piece and also, the pressure contact portion between the rollers can be secured more widely.

Accordingly, as the paper P having the toner image T thereof passes through this pressure contact portion, the toner image is rapidly melted and reliably fixed onto the paper P because the surfaces of the rollers 1 and 2 are thermally uniformized.

The roller construction of FIG. 2 will be described in greater detail. The wall thickness d of the heating-fixing roller will first be described. As the wall thickness d is made smaller, the time required for heating becomes less and thus, reduction in the wait time of the entire fixing device can be achieved. When such a thinnest possible roller is made, the strength calculation for maintaining the mechanical strength of the roller is usually carried out with the diameter of the roller, the Young's modulus of the material forming the roller, etc. taken into account.

However, it has been found that even if the wall thickness is set so as to obtain a predetermined strength, the temperature distribution in the surface of the heating-fixing roller may sometimes become non-uniform and the fixativeness may become rather worse. For example, a thin wall thickness may cause such a localized overheating phenomenon that a similar heat cannot be maintained for the entire surface of the roller or may cause the heat transfer on the surface of the roller to be slow, so that the heat transferability particularly in the direction of the bus line of the heating-fixing roller surface is not obtained. Also, a thin wall thickness may provide the adaptability to heat but is liable to be affected by the heat emitting characteristic of the heat source and this may give rise to the problems in heat maintaining property and strength and in some cases, sufficient fixation cannot be accomplished.

That is, it is most effective that the minimum necessary wall thickness which will shorten the wait-up time is selected to such a wall thickness that will readily permit the transfer of heat in the direction of the bus line of the fixing roller and the pressing roller is urged against the fixing roller with such a total pressure that the mandrel of that wall thickness does not permanently fluctuate.

The inventor has found that as regards the wall thickness d, the wall thickness which conforms to a formula that $5/r < d \leqq r/10$, where r(mm) is the outer diameter of the rotational member, solves the above-noted problems. The inventor has further found that if the wall thickness d becomes greater as when the outer diameter r is 30 mm or greater, the heat capacity will become greater and therefore, if the wall thickness d is selected to 3 mm or less with the strength taken into account, there can be obtained preferable heat conductivity.

Further, the present embodiment has a construction which can solve the problem peculiar to a case where it is desired to further shorten the wait time by solving the above-noted problems peculiar to the heating-fixing roller or a case where preference is given to the mechanical strength and the wall thickness or the material of the fixing roller from the thermal point of view cannot be freely selected. That is, such problem is solved by assuming the fixing construction of the present embodiment which compensates for the disadvantage peculiar to a thin-walled fixing roller that the transfer of heat in the direction of the bus line does not take place, by the structure of a roller opposed to and urged against the fixing roller (that is, bringing a pressing roller having a porous layer containing air as previously described and a smooth surface layer into contact with the fixing roller.

Thus, most of the heat from the surface of the fixing roller transfers to the pressing roller except the heat emission into the air and the escape of heat to the fixing roller supporting member.

At this time, heat rapidly transfers only to the surface of the coating layer of the pressing roller because the inside of the pressing roller is a porous layer which is not ready to transfer heat, thus assisting in the heat transfer in the direction of the bus line of the fixing roller. Further, the transfer of heat to the pressing roller is remarkably poorer than in the conventional roller of solid rubber and this has led to the possibility of providing a roller construction which shortens the wait-up time and which is nearly free of the phenomenon of falling during the fixing operation.

Accordingly, even if the amount of heat by the toner per unit time is the same, heating and contact can take place for a long time and therefore, heat can be imparted to the toner image (or the paper P). At this time, in the paper P which is an example of the supporting member, wrinkles which are liable to occur during fixation have not occurred in spite of the fact that the step of working the paper into an inverted crown shape or the like which is generally known as the measure against wrinkling is not taken.

Figure 4:
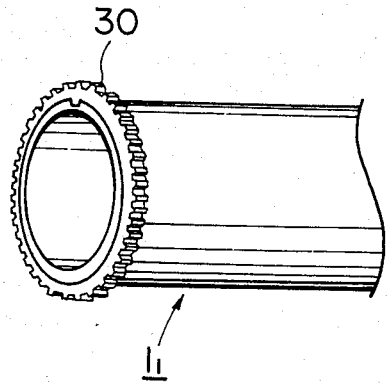
FIG. 4 illustrates the major portions of the FIG. 3 embodiment.

Referring now to FIGS. 3 and 4, a fixing roller $1_1$ comprises a cylinder. This fixing roller $1_1$ is formed by a thin-walled pipe $5_1$ of aluminum and a tetrafluoroethylene resin layer $6_1$ of 25–30$\mu$ applied as an offset preventing layer onto the surface of the pipe $5_1$. At the opposite ends of the fixing roller $1_1$, there are provided cut-outs 30*a* which provide the fitting grooves for a driving gear (which will later be described). In FIG. 3, letter A designates an area through which sheets of B5 size pass, letter B denotes an area through which sheets of A4 size pass, and the opposite end portions thereof are sheet non-passage areas C.

Reference numerals 31*a* and 31*b* designate antifriction bearings which rotatably support the fixing roller $1_1$. These bearings 31*a* and 31*b* are mounted on the support frame (not shown) of the fixing device. Designated by 30 is a driving gear securely fitted to the fixing roller $1_1$ at the cut-out portion 30*a*. The driving gear 30 receives the drive from a drive source 33 on the copying apparatus body side through a gear 29 on the apparatus body side and rotates the fixing roller $1_1$. Denoted by $4_1$ is a halogen heater as a heat source held by support members 4*a* and 4*b* which serve also as electrodes. The halogen heater $4_1$ is ON-OFF-controlled by a temperature detecting element $13_1$ in contact with the surface of the fixing roller $1_1$ and a control circuit (not shown) so as to maintain the surface of the fixing roller $1_1$ at a predetermined temperature. Since the driving gear 30 is fitted to the cut-out portion 30*a* and secured to the peripheral surface of the fixing roller $1_1$ as by screws, any deviation of the fixing roller $1_1$ relative to the bearings 31*a* and 31*b* is prevented.

A pressing roller $2_1$ which is urged against the fixed roller $1_1$ comprises a mandrel 7 of stainless steel, a heat-resistant porous elastic layer $8_1$ provided around the mandrel, and a very thin elastic layer $9_1$ of silicone rubber covering the surface of the layer $8_1$. The mandrel 7 is also rotatably supported by antifriction bearings 17*a* and 17*b*.

Again in the present embodiment, the effect as previously described is obtained. Uniformity of the surface temperature of the fixing roller $1_1$ is promoted by the aforementioned action of the elastic layer $9_1$ of the pressing roller $2_1$ and the shortening of the wait time which is a feature of each roller can be further improved.

In the present embodiment, the fixing roller $1_1$ and pipe $5_1$ are cylinders of substantially the same diameter having open opposite ends. Thus, in the present embodiment, temperature rise of the sheet non-passage area C on the peripheral surface of the roller can be effectively prevented to permit efficient escape of excess heat to the outside. Moreover, the amount of heat taken to the roller supporting portion during heating is decreased, so that the peripheral surfaces of the rollers $1_1$ and $9_1$ can quickly reach a predetermined uniform temperature. Also, in the present embodiment, the pipe $5_1$, together with the sheet passage area (A or B) and the bearing portion on which the bearing for supporting the pipe $5_1$ is mounted, lies on the same bus line. Thus, there is no possibility that the localized great thickness of the roller which may occur when the fixing roller (particularly, the example shown in FIG. 2) is manufactured by the use of a method such as bulge pressing or cold tube forging occurs, and also by this, the heat distribution in the peripheral surface of the roller is made uniform and the temperature thereof rises to a uniform temperature.

Accordingly, in the present embodiment, the wall of the pipe $5_1$ can be formed into a uniformly thin wall in both the sheet passage area (A or B) and the bearing portion on which the bearing for supporting the pipe $5_1$ is mounted, namely, over the entire area of the pipe $5_1$, thus decreasing the non-uniformity of heat distribution and maintaining the peripheral surface of the roller at a uniform temperature. Further, the manufacturing process can be shortened.

Figure 5:
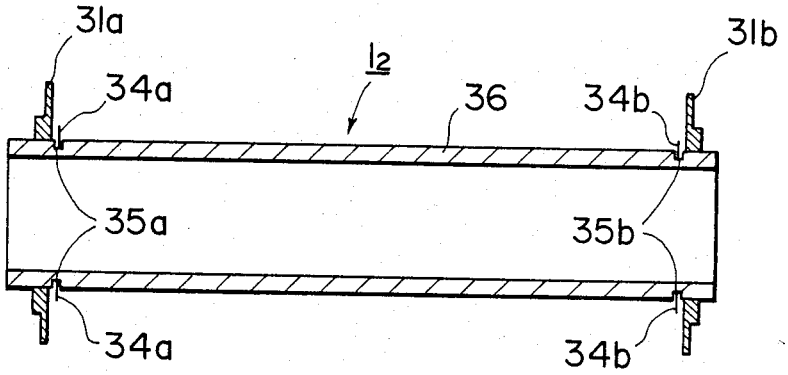
FIGS. 5 to 7 illustrate embodiments of the heating-fixing roller which are applicable to the present invention.
Figure 6:
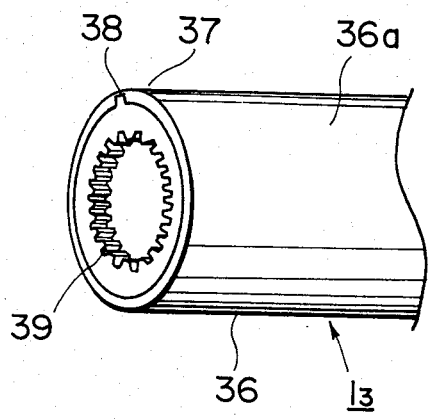
Figure 7:
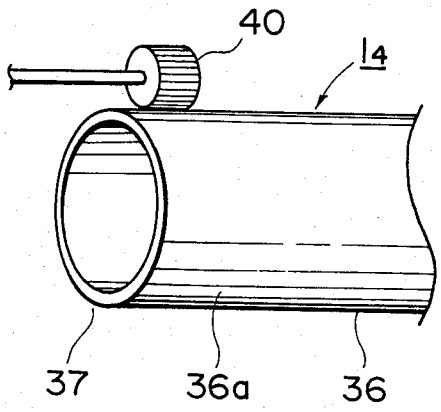

FIGS. 5 to 7 show examples of the heating-fixing roller which is applicable to the above-described apparatus and which can provide substantially the same degree of effect.

In the embodiment of FIG. 5, instead of preventing the "slip-out" or "deviation" of a cylinder 36 by driving gears 29 and 30 as shown in FIG. 4, shaft stoppers 34*a* and 34*b* such as, for example, C-rings, are engaged with grooves 35*a* and 35*b* formed in the peripheral surface of the cylinder 36. Also by this, the "slip-out" or "deviation" of the cylinder 36 relative to bearings 31*a* and 31*b* can be prevented and the cylinder 36 can be rotated always at a predetermined position.

FIG. 6 shows a further embodiment.

In this embodiment, a driving gear 39 is secured to the inside of an end portion 37 of the cylinder 36 like a paper non-passage portion. The driving gear 39 is fitted to the cut-out portion 38 of the cylinder 36. In the present embodiment, the rate at which the end portion 37 of the cylinder is opened is a little decreased as compared with than in the previous embodiment, for the purpose of transmission of the drive, but the other end of the cylinder 36 is fully opened to thereby enable the aforementioned sufficient effect to be obtained.

FIG. 7 shows another embodiment of drive transmission.

In this embodiment, a driving roller 40 is urged against the peripheral surface of the end portion 37 of the cylinder 36 and the cylinder 36 is rotated by the rotative drive of the driving roller 40. The driving roller 40 is rotatively driven by receiving the drive from a drive source (not shown) on the body side.

In any of the above-described embodiment, the drive of the body side is transmitted to the fixing roller $1_2$, $1_3$, $1_4$, but for example, the drive may be transmitted to the pressing roller by a similar method. As a further alternative, the drive may be transmitted to the two rollers.

In the above-described embodiments, heat cannot stagnate within the fixing roller and therefore, the temperature rise in the peripheral surface of the roller in the sheet non-passage area can be suppressed within about 30°–40° C. Also, the time required for the wait-up from after the heater is energized upon start of the heating until the peripheral surface of the roller uniformly reaches the vicinity of 180° C. can be shortened by about five seconds as compared with the case where use is made of a roller having a support portion whose end is of a small diameter (in the past, twenty seconds has been required, but only fifteen seconds is required in the present embodiment).

Thus, there is no possibility that the localized great thickness of the roller which has heretofore occurred when the fixing roller is manufactured by the use of a method such as bulge pressing or cold tube forging occurs. Also by this heating-fixing roller, the heat distribution in the peripheral surfaces of the fixing roller and the pressing roller is made uniform over the entire area and the temperature of said peripheral surfaces rises to a uniform temperature.

Some specific examples to which the present invention is applied will hereinafter be described.

Specific Example 1

A heating-fixing roller comprising a rotational member of aluminum having a full length of 230 mm, an outer diameter of 25 mm and a wall thickness of 1.6 mm and coated with a tetrafluoroethylene layer of 25 μm and containing a halogen heater of 1.2 KW therein was used, and a pressing roller having an outer diameter of 24 mm and having a silicone cellular layer of 6 mm thickness as an inner layer and a rubber surface layer of 0.7 mm thickness on the cellular layer was used. The temperature of the surface of the heating roller was usually set to 180° C., and the heater was designed to become operative upon closing of the main switch.

In this specific example, even in the usually urged condition, the wait time was greatly shortened (in the past, four to five minutes was required, but in the present example, only about 15 to 20 seconds was required), and the wait time could be further decreased as compared with (1) an arrangement in which a silicone rubber single piece roller was pressed against the heating roller or (2) an arrangement in which an ordinary heating roller was urged against the pressing roller. Much more uniform temperature distribution than in the arrangements (1) and (2) was obtained, and images of high quality having particularly good fixation were obtained.

Specific Example 2

The heating-fixing roller 1 comprises a cylindrical roller of aluminum having an outer diameter of 25 mm, a length of about 280 mm and a wall thicknes,s of 1.6 mm and a coating layer of tetrafluoroethylene-perfloro alkoxyethylene copolymer (P.F.A.) having a thickness of 25 $\mu m_{-5\mu}^{+10\mu}$.

The pressing roller 2 is a roller having an outer diameter of about 24 mm and a length of about 230 mm which comprises a mandrel of 10ϕ, an HTV (high temperature vulcanization type) silicone cellular layer of 6 mm thickness on the mandrel, and an RTV (room temperature vulcanization type) silicone rubber layer of 0.7–1 mm thickness on the outer periphery of the cellular layer.

A gear is fitted on the surface portion of the heating-fixing roller 1 which does not contact the pressing roller 2, and a halogen heater of 1.0–1.2 KW is contained therewithin. The pressing roller 2 is normally urged against the heating-fixing roller 1 with a total pressure of about 7 kg. The width of the pressure contact portion is about 2.5–3.0 mm.

The heating-fixing roller 1 is driven and the pressing roller 2 follows it.

The hardness of the silicone cellular layer is 27°±3° as measured by an Asker C type rubber hardness meter for cellular material (a product of High Molecule Science Co., Ltd.) with a load of 300g added thereto.

The step of fixing a toner image on paper by the use of a fixing device of the above-described construction was carried out. By this, the wait time from a point of time whereat a current was applied to the heater of the heating-fixing roller until the surface temperature of the fixing roller reached 180° C. was only of the order of fifteen seconds. The surface temperature of the pressing roller could rise to 160° C. Further, the toner image could be fixed on the paper with substantially uniform fixing characteristics.

This excellent epoch-making result could be appreciated if compared with the fact that a wait time of four to ten minutes was required in any conventional heating-fixing device. The pressing roller of the conventional device had a rubber layer of 10 mm and therefore could only be heated to the order of 70° C. at highest. That is, the pressing roller of the above-described example can be rapidly heated to 160° C. and therefore, the wait time can be reduced. Also, this pressing roller has sufficient elasticity and it will therefore be appreciated that it can improve fixation.

The silicone cellular layer in the above-described specific examples 1 and 2 was formed by the tubing method or by the impregnation type method using a paper tube. The tubing method comprises pouring out high-temperature-vulcanized silicone rubber from a container having a ring-shaped opening, thereafter placing the cylindrical rubber tube into a cylindrical heater, heating the rubber tube from around it and causing it to be foamed, thereby forming a cellular material tube. The shape of the cellular material tube is determined by the inner diameter of the ring-shaped opening and the inner diameter of the cylindrical heater. The pressing roller was formed by the following procedures. The cellular material tube has a skin layer on its surface and so, that layer is sucked from around it, whereby the inner diameter thereof is widened. A mandrel having a silicone primer for adhesion applied to the surface thereof is inserted into the inner diameter. Thereafter, the suction is released and the cellular material tube is bonded to the mandrel. Further, the surface of the cellular material tube is made into a cellular layer of a predetermined thickness so that the skin layer on the surface of the cellular material tube is shaved. The surface of this cellular layer is laminated-coated with RTV silicone rubber to a predetermined thickness. Thereafter, finish polishing is effected to provide the above-described pressing roller.

The impregnation type method using a paper tube comprises inserting a primer-treated mandrel into a cylindrical paper tube having a predetermined diameter, pouring high-temperature-vulcanized silicone rubber between the paper tube and the mandrel, heating it and making it into a cellular silicone rubber layer. Further, thereafter, the paper tube is shaved away and polished. Such a process is called a press-in type method using a paper tube. Thereafter, the shaping of the pressing roller may be effected by the laminate coating of the above-described RTV silicone rubber.

In the above-described specific examples, the construction of the pressing roller has a great effect in uniformizing the temperature distribution relative to the heating roller and in shortening the wait time.

This could prevent the reduction in fixation during the wait-up which could heretofore not be solved by any means because the heat conduction of the roller was extremely poor and the reduction in the surface temperature of the roller immediately after the wait-up was small.

That is, the heat conductivity in the surface layer is greater than the heat conductivity in the inner layer of the roller as in the cellular layer, whereby the heat efficiency can be improved and heat can effect uniformity of the surface temperature of the heating roll.

Further, like the cellular layer, the elastic modulus of the inner layer of the roller is greater than that of the surface layer and therefore, a large pressure contact portion relative to the heating roller surface can be formed in a stable condition. Consequently, in the above-described examples, there is obtained a preferable effect that the heat conduction of the heating roller can be coped with and the surface temperature of the heating roller can be reliably ensured.

Further, the rollers are manufactured in the manner described above and therefore, the amount of rubber used is decreased to about ½ or less and this contributes to the saving of the material and the reduced cost.

Also, a large and uniform contact portion can be secured with the contact pressure between the pressing roller and the fixing roller reduced and therefore, the torque for driving can be reduced and it has become possible to reduce the ill effect of the compressive permanent distortion of the rubber roller.

When an experiment has been carried out to obtain a more preferable embodiment, the inventor has found that the embodiment which satisfies the following conditions is more preferable.

It has been found that when a roller is formed of a single silicone cellular material layer and used for fixation, the cells thereof cause creation of portions good in fixation and portions bad in fixation and this is not preferable and the roller having surface smoothness is preferable. That is, it is more preferable in obtaining higher fixation that the surface layer of the pressing roller have surface smoothness.

Also, from another point of view, an experiment was carried out on the thicknesses of the silicone surface layer from 0.3 mm to 5 mm. As a result, it was found that if the thickness was too great, the effect of the cellular layer abounding in elasticity and restitutional property could not be utilized so effectively and that if the thickness was too small, it resulted in decreased strength and increased cost of manufacture as well as poor stability and therefore, a thickness of 0.01–2 mm was preferable, a thickness in the range of 0.5 to 2 mm was more preferable and a thickness of 0.7–1 mm was still more preferable (but this was with respect to the roller diameter of 25$\phi$).

When this has generally been taken into account with the other result (not shown herein), it has been found that a thickness of ¼ or less of the thickness of the lower elastic layer such as the silicone cellular layer is preferable for the surface layer of good heat conductivity.

Also, to form a silicone cellular layer as another embodiment of the pressing roller, use may be made of not only the method of applying a cellular material tube but also a method of applying rubber around an ordinary mandrel, causing the rubber to be foamed and thereafter vulcanizing it.

As an inexpensive method, when the cellular layer is made by the use of a metal mold, the surface layer may be formed at the same time without the outer side thereof being caused to be foamed or a tube of silicone rubber may be applied, whereafter it may be placed into a metal mold and, by the use of an injection system, NVR (low temperature vulcanization type) silicone rubber may be poured into between the cellular layer and the metal mold. This eliminates the necessity of effecting finish polishing because of the accuracy of the parting surface of the metal mold and is suitable for mass production.

The pressing roller may be a rotational member of multilayer structure which comprises a substrate, an elastic layer disposed on the substrate and formed of a material having a relatively poor heat conductivity but abounding in elastic restitutional force such as a silicone cellular layer or a porous layer formed of fluorine rubber, and a thin heat-conductive heat-resistant layer of silicone rubber or the like provided on the surface of the elastic layer. Thus, it is possible to form a uniform predetermined nip width (pressure contact force) by a low contact pressure.

The surface parting substrance provided on the surface of the heating-fixing roller 1 or the fixing roller $\mathbf{1}_1$ need not always be provided, whereas it should preferably be provided for the purpose of offset prevention. Such material may be tetrafluoroethylene, fluorince resin such as FEP resin or PFA resin, or silicone resin or rubber.

Although not described in connection with FIGS. 1 and 2, the pressure contact force between the fixing roller and the pressing roller may be small because the amount of deformation of the pressing roller is great and the heat efficiency in the pressure contact portion is very preferable, but for the purpose of improving the durability of these rollers, the total pressure applied between the fixing and pressing rollers when an object to be fixed such as an unfixed image is fixed or when a recording medium such as paper is passed between the rollers should preferably be 20 kg or less. This is also effective to prevent wrinkling of paper.

By using a heating-fixing device like the above-described fixing device which comprises a thin-walled rotational member and a heat-resistant rotational member having a porous elastic layer of cellular material as the inner layer and a thin heat-resistant surface layer of silicone rubber on the surface of the elastic layer, there occurs a combined action of the two rotational members and thus, it has become possible to obtain an ideal device in which the wait time is very short and uniform heating and fixation of the object to be fixed is possible.

Further, the provision of the thin-walled rotational member has led to the possibility of greatly reducing the wait time during the starting.

What I claim is:

1. A fixing device, comprising:

first and second rotating members arranged to form a nip therebetween to grip and transport therebetween an image bearing member having an unfixed image on one surface thereof and thereby to fix the image on the image bearing member;

means for urging one of said rotating members toward the other;

means for heating at least the first rotating member, said heating means being provided inside of said at least the first rotating member; and said second rotating member having on its surface a first layer formed of heat-resistant resin and a second layer provided inside of said first layer and formed silicone rubber sponge having a number of gas cells, said second rotating member contacting the surface of said image bearing member opposite the surface bearing said unfixed image to urge said unfixed image to the first rotating member.

2. A fixing device according to claim 1, wherein said heating means is provided inside of the first rotating member and said second rotating member contacts the surface of said image bearing member opposite the surface bearing said unfixed image to urge said unfixed image to the first rotating member.

3. A fixing device according to claim 1, wherein said first layer is a layer of silicone rubber and said second layer is a sponge layer of silicone rubber.

4. A fixing device according to claim 1, wherein said second rotating member has on its rotating center shaft a coating of a primer of silicone series and said second layer of silicone rubber sponge on said coating.

5. A fixing device according to claim 2, wherein said second rotating member has on its rotating center shaft a coating of a primer of a silicone series and said second layer on said coating.

6. A fixing device according to claim 3, wherein said first layer is formed of silicone rubber material and said second layer is formed of silicone rubber material.

7. A fixing device according to claim 4 or 5, wherein said first layer is of RTV silicone rubber material, said second layer is of HTV silicone rubber material and said primer is of one-liquid type RTV silicone rubber material.

8. A fixing device according to one of claims 1 to 6, wherein said second layer is exposed at side surfaces of both ends in the axial direction of said second rotating member and at said side surfaces of said both ends, said first layer does not cover said side surfaces of said second layer.

9. A fixing device according to one of claims 1 to 6, wherein said urging means applies a pressure of less than 20 kg in total between said first and second rotating members while the image bearing member passes between the first and second rotating members.

10. A fixing device according to claim 8, wherein said urging means applies a pressure of less than 20 kg in total between said first and second rotating members while said image bearing member passes between the first and second rotating members.

11. A fixing device according to one of claims 1 to 6, wherein the thickness of said first layer is less than one fourth that of said second layer.

12. A fixing device according to claim 11, wherein the thickness of said first layer is more than 0.5 mm but less than 2 mm.

13. A fixing device according to claim 12, wherein the thickness of said first layer is more than 0.7 mm but less than 1 mm.

14. A fixing device comprising:

first and second rotating members arranged to form a nip therebetween to grip and transport therebetween an image bearing member having an unfixed image on one surface thereof thereby to fix the image on the image bearing member;

means for urging one of said rotating members toward the other;

said first rotating member provided with heating means therewithin, arranged directly to contact said unfixed image and being a cylindrical roller having a hollow and thin thickness metallic layer open at both ends; and said second rotating member arranged to contact a surface of said image bearing member opposite to the surface thereof bearing said unfixed image, and having on its surface a first layer formed of heat-resistant elastic resin and a second layer provided inside of said first layer and formed of porous elastic resin having a number of gas cells.

15. A fixing device according to claim 14, wherein the thickness d of the metallic layer of said first rotating member satisfies the relationship of $5/r \leqq d \leqq r/10$, where r is an external radius of said cylindrical roller.

16. A fixing device according to claim 15, wherein the thickness (d) of the metallic layer is less than 3 mm.

17. A fixing device comprising:

first and second rotating members arranged to form a nip therebetween to grip and transport therebetween an image bearing member having an unfixed image on one surface thereof thereby to fix the image on the image bearing member;

means for urging said rotating members towards each other;

said first rotating member provided with heating means therewithin, arranged directly to contact said unfixed image and having a hollow and thin thickness metallic roller, the thickness d of the roller satisfying the relationship of $5/r \leqq d \leqq r/10$, where r is an external diameter of said roller; and said second rotating member arranged to contact a surface of said image bearing member opposite to the surface thereof bearing said unfixed image, and having on its surface a first layer formed of heat-resistant elastic resin and a second layer provided inside said first layer and formed of porous elastic resin having a number of gas cells.

18. A fixing device according to claim 17, wherein said thickness d is less than 3 mm.

19. A fixing device according to one of claims 14 to 18, wherein said first rotating member provides at the end of the roller a gear receiving a drive from a driving source and both ends of said roller are engaged with a bearing.

20. A fixing device according to one of claims 14 to 18, wherein said porous eastic resin of the second layer is silicone rubber.

21. A fixing device according to claim 20, wherein said second rotating member has a coating on its rotating center shaft of a primer of silicone series and a second layer of silicone rubber.

22. A fixing device according to claim 20, wherein said first layer is formed of silicone rubber and said second layer is formed of silicone rubber sponge.

23. A fixing device according to claim 21, wherein said primer is formed of silicone rubber.

24. A fixing device according to claim 21, wherein said first layer is formed of RTV silicone rubber and said second layer is formed of HTV silicone rubber sponge and said primer is formed of one-liquid type RTV silicone rubber.

25. A fixing device according to one of claims 14 to 17, wherein said second layer is exposed at side surfaces of both ends in the axial direction of said second rotating member and at said side surfaces of said both ends, said first layer does not cover said side surfaces of said second layer.

26. A fixing device according to claim 17, wherein said urging means applies a pressure of less than 20 kg in total between said first and second rotating members while the image bearing member passes between the first and second rotating members.

27. A fixing device according to claim 20, wherein said second layer is exposed at side surfaces of both ends in the axial direction of said second rotating member and at said side surfaces of said both ends, said first layer does not cover said side surfaces of said second layer.

28. A fixing device according to claim 27, wherein said urging means applies a pressure less than 20 kg in total between said first and second rotating members while said image bearing member passes between said first and second rotating members.

29. A fixing device according to claim 17, wherein said second rotating member is formed by, after inserting a core coated with the primer into the second layer of silicone rubber sponge preformed to be cylindrical, grinding the surface of said second layer and further forming the first layer by laminate-coating or by covering a cylinder preformed into a tube shape.

30. A fixing device according to one of claims 14 or 17, wherein said second layer is of silicone rubber and said fixing device has means to coat the surface of the first rotating member with off-set preventing liquid.

31. A fixing device according to claim 1, wherein said first rotating member includes a thin metallic layer and a thin offset-preventing layer on said metallic layer.

* * * * *

UNITED STATES PATENT AND TRADEMARK OFFICE

CERTIFICATE OF CORRECTION

PATENT NO. : 4,533,231

DATED : August 6, 1985

INVENTOR(S) : FIXING DEVICE

It is certified that error appears in the above-identified patent and that said Letters Patent is hereby corrected as shown below:

On the Cover Sheet. in the Abstract, "cellulars" should read --cellular--.

Column 2, line 14, "non-porus" should read --non-porous--;
line 16, "eleastic" should read --elastic--;
line 58, "illustates" should read --illustrates--.

Column 3, line 9, "agianst" should read --against--.

Column 4, line 56, "aiblity" should read --ability--.

Column 5, line 13, "is.," should read --is,--;
line 14, after "fixing" insert --ability--.

Column 6, line 37, "cellulars" should read --cellular--.

Column 7, line 36, "heatingfixing" should read --heating-fixing--.

Column 14, line 68, Claim 1, after "formed" insert --of--.

UNITED STATES PATENT AND TRADEMARK OFFICE

CERTIFICATE OF CORRECTION

PATENT NO. : 4,533,231

DATED : August 6, 1985

INVENTOR(S) : FIXING DEVICE

It is certified that error appears in the above-identified patent and that said Letters Patent is hereby corrected as shown below:

Column 15, lines 6 - 11, Claim 2, should be cancelled in their entirety;
line 19, Claim 5, "2" should read --1--;
line 23, Claim 6, "3" should read --5--;
line 26, Claim 7, "5" should read --6--;
line 31, Claim 8, "1" should read --1, 3--;
line 37, Claim 9, "1" should read --1, 3--;
line 47, Claim 11, "1" should read --1, 3--.

Column 16, line 42, Claim 20, "eastic" should read --elastic--.

Signed and Sealed this

*Twenty-sixth* Day of *August 1986*

[SEAL]

*Attest:*

DONALD J. QUIGG

*Attesting Officer* *Commissioner of Patents and Trademarks*